United States Patent [19]

Tannahill

[11] Patent Number: 4,556,342

[45] Date of Patent: Dec. 3, 1985

[54] METHOD OF FABRICATING A BROAD-BASED SUBMERSIBLE STRUCTURE

[75] Inventor: Clifton A. Tannahill, Houston, Tex.

[73] Assignee: Union Oil Company of California, Los Angeles, Calif.

[21] Appl. No.: 609,101

[22] Filed: May 8, 1984

[51] Int. Cl.[4] ..... E02D 21/00; E02D 25/00; B23P 21/00

[52] U.S. Cl. ..... 405/203; 405/204; 114/77 R; 114/264; 29/469

[58] Field of Search ..... 405/195, 203–207, 405/209, 224; 114/77 R, 77 A, 258, 264, 265, 65 R; 29/469, 428, 429; 52/116, 120, 741, 745, 747

[56] References Cited

U.S. PATENT DOCUMENTS

| | | | |
|---|---|---|---|
| Re. 29,413 | 9/1977 | Hekkanen et al. | 405/204 |
| Re. 30,825 | 12/1981 | Guy et al. | 405/204 |
| 2,586,966 | 2/1952 | Kuss et al. | 405/203 X |
| 3,094,847 | 6/1963 | Pogonowski | 405/204 |
| 3,729,940 | 5/1973 | Koehler | 405/205 |
| 4,018,057 | 4/1977 | Erzen et al. | 405/205 X |
| 4,064,616 | 12/1977 | Kubota et al. . | |
| 4,080,916 | 3/1978 | Nastasic et al. . | |
| 4,135,842 | 1/1979 | Blight et al. | 405/209 |

FOREIGN PATENT DOCUMENTS

| | | | |
|---|---|---|---|
| 55-142809 | 7/1980 | Japan . | |
| 1491684 | 11/1977 | United Kingdom | 405/204 |

*Primary Examiner*—Cornelius J. Husar
*Assistant Examiner*—Nancy J. Stodola
*Attorney, Agent, or Firm*—Robert J. Baran; Dean Sandford; Gregory F. Wirzbicki

[57] ABSTRACT

This invention provides a method for fabricating a broad-based submersible structure useful for deep water installations. In this method the lower portion of said structure is fabricated in two half-sections. The first half-section of said braod-based submersible structure is fabricated in a substantially horizontal position, and then raised from the ground to a height sufficient to enable a second half-section (also fabricated in a substantially horizontal position) to be moved therebeneath. The second half-section is aligned with said raised first half-section and said aligned half-sections are joined to provide the lower portion of the structure. The lower portion of the structure may be then joined to the upper portion of said structure to provide said broad-based submersible structure in a horizontal position, and the structure rotated from a substantially horizontal position to a vertical position.

21 Claims, 5 Drawing Figures

METHOD OF FABRICATING A BROAD-BASED SUBMERSIBLE STRUCTURE

BACKGROUND OF THE INVENTION

1. Field of the Invention

The invention relates to the fabrication of submersible structures useful for deep water installation. Such submersible structures may be incorporated into offshore oil drilling and production platforms.

2. Summary of the Art

It is known that one problem in the design of fixed offshore structures for water depths beyond 1,000 feet is in keeping the natural period of vibration within acceptable limits. This problem may be solved by increasing the width at the base to provide greater stability and structural stiffness; however, increasing the width is no simple matter.

The lower, or below water portion of a submersible structure, is normally fabricated lying on its side. The width of the base of such structure is limited by the working height of the cranes available for assembling the various components. The width of the base for one-piece fabrication is limited to approximately 300 feet for equipment available at the principal fabrication sites.

A submersible structure for a water depth of 1,025 feet has been fabricated in three pieces. The base of said structure had a width of approximately 400 feet, but it was fabricated in the vertical position to a height of only about 200 feet. This structure was installed on the sea bottom with two upper sections added to complete the structure.

A method of fabricating a tower structure for a maritime platform assembly in two pieces is disclosed in U.S. Pat. No. 4,080,916. The disclosed method includes fabricating two half-sections of the tower in a horizontal position and then rotating each half-section to the vertical and securing them to each other to provide a vertically standing tower. Since the tower is assembled on the ground, the height of the tower is limited by the available crane height, or separate rearing towers must be provided to assist in rotating the half-sections to the vertical. As shown, the cranes utilized in rotating the half-sections to the vertical are the track-mounted mobile cranes used in the prior art methods for fabricating submersible towers.

It is thus clear that current methods for the fabrication of broad-based submersible towers are limited by the height of mobile cranes or require additional structural towers to overcome crane height limitations.

Therefore it is a primary object of this invention to provide a method for fabricating broad-based submersible towers that is not limited by the height of the mobile cranes generally utilized in fabricating submersible structures.

It is another object of this invention to provide a method for fabricating submersible structures without the use of rearing towers.

Other objects and advantages of this invention will be apparent from the following specification.

SUMMARY OF THE INVENTION

The instant invention provides a method for fabricating a broad-based submersible structure having an upper portion and a lower portion and useful for deep water installations which method comprises:

(a) fabricating a first half-section of the lower portion of said broad-based submersible structure in a horizontal position, (b) fabricating a second half-section of the lower portion of said broad-based submersible structure, in a horizontal position, near said first half-section, (c) raising said first half-section from the ground to a height sufficient to enable said second half-section to be moved therebeneath, (d) aligning said second half-section beneath said raised first section, and (e) joining said aligned half-sections to provide said lower portion.

The first half-section may be raised by two or more stiff legged cranes, which are suitable for raising heavy structures that require only vertical movement.

The lower portion may be joined to the upper portion to provide said broad-based submersible structure in a horizontal position.

In this embodiment, the broad-based, submersible structure must be rotated from the horizontal position to a generally vertical position during or prior to installation. Conveniently, the complete submersible structure is installed by floating the structure in a horizontal position to a deepwater site on a raft and then tipping it, the structure to slide base first, from the raft into the water. Therefore, no crane or other structure is needed to rotate the submersible structure to the vertical.

Alternatively, the lower portion of the broad-based submersible structure may be placed on the floor of a body of water and then the upper portion joined thereto.

BRIEF DESCRIPTION OF THE DRAWING FIGURES

DETAILED DESCRIPTION OF THE INVENTION

The instant invention covers a method for fabricating a broad-based submersible structure and structures prepared by said method of fabrication. The method and structures are illustrated by FIGS. 1 through 5 wherein like numerals refer to like members and said members are assembled to form segments of the structure being fabricated. These segments are designated by the other numerals.

Figure 1:
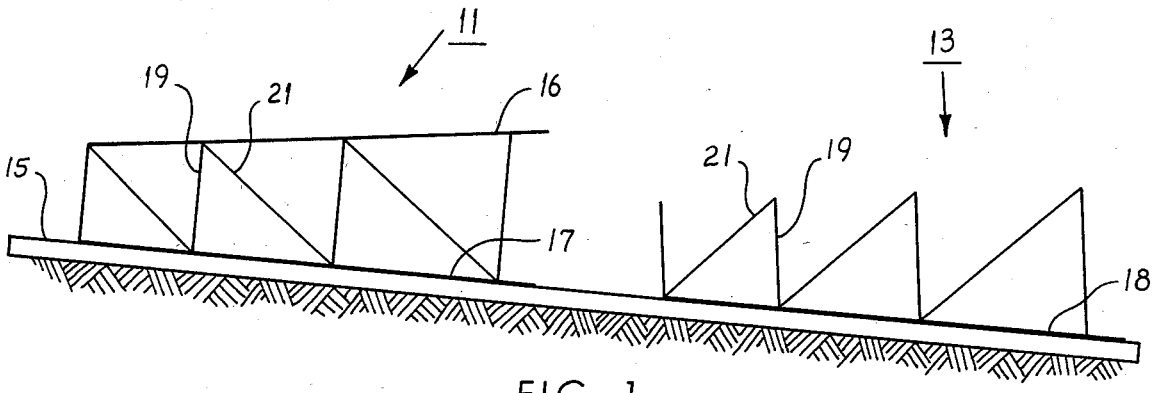
FIG. 1 is a horizontal view of the lower portion of the submersible structure of the instant invention showing the two half-sections thereof as separately fabricated.
Figure 5:
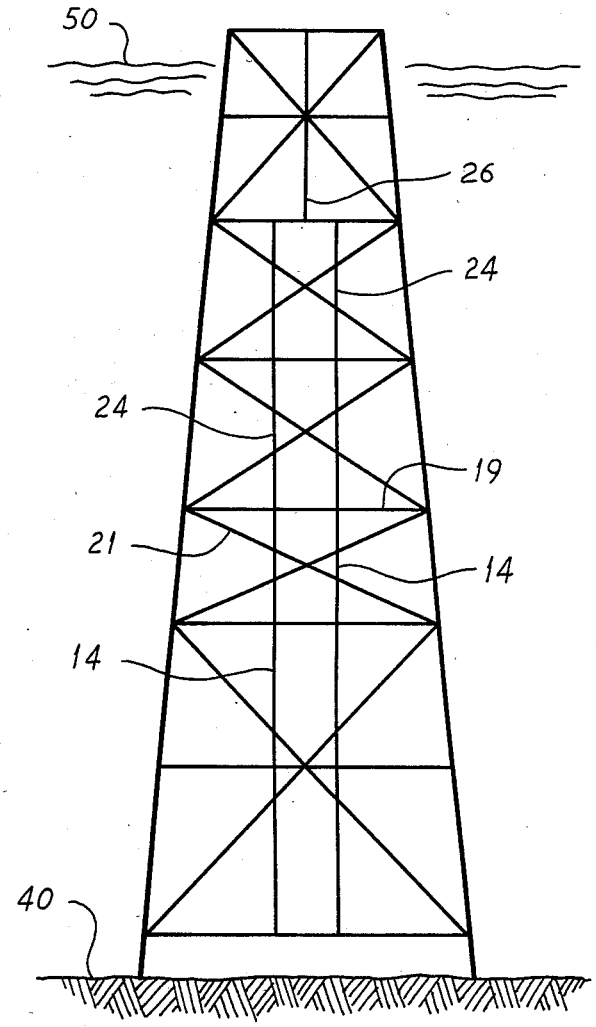
FIG. 5 is a side view of the installed submersible structure of FIG. 4.

In FIG. 1 a first half-section 11 of a broad-based submersible structure is shown lying adjacent to a second half-section 13 of said submersible structure. Both half-sections are located over a skidway 15. Half section 11 includes four longitudinal tubulars on both the top and bottom. The exterior (or corner) tubulars are designated as 16 and 17 for the top and bottom, respectively. The interior (or truss) tubulars are shown in FIG. 5 and designated as 14. Half section 13 also has four longitudinal tubulars at the bottom only. The corner tubulars are designated as 18. The interior (or truss) tubulars of half-section 13 as well as the upper interior (or truss) tubulars of first half-section 11 are not shown in any of the figures due to their orientation away from the viewer. The longitudinal tubulars may be of any suitable length since the lower portion of the submersible structure of this invention is not assembled by rotating said tubular members from the horizontal to the vertical. Therefore, crane height limitations are not a factor in selecting the length of the longitudinal tubulars. Both half-sections further comprise a plurality of cross members 19 and diagonal braces 21. The diagonal braces are provided to enhance the structural integrity of the half-sections.

The two interior (or truss) tubulars of half-section 13 rest on two parallel skidways 15 that extend underneath half-section 11. The cross members and diagonals at the top of half-section 13 are coped to fit the bottom longitudinal members 17 of half-section 11.

Figure 2:
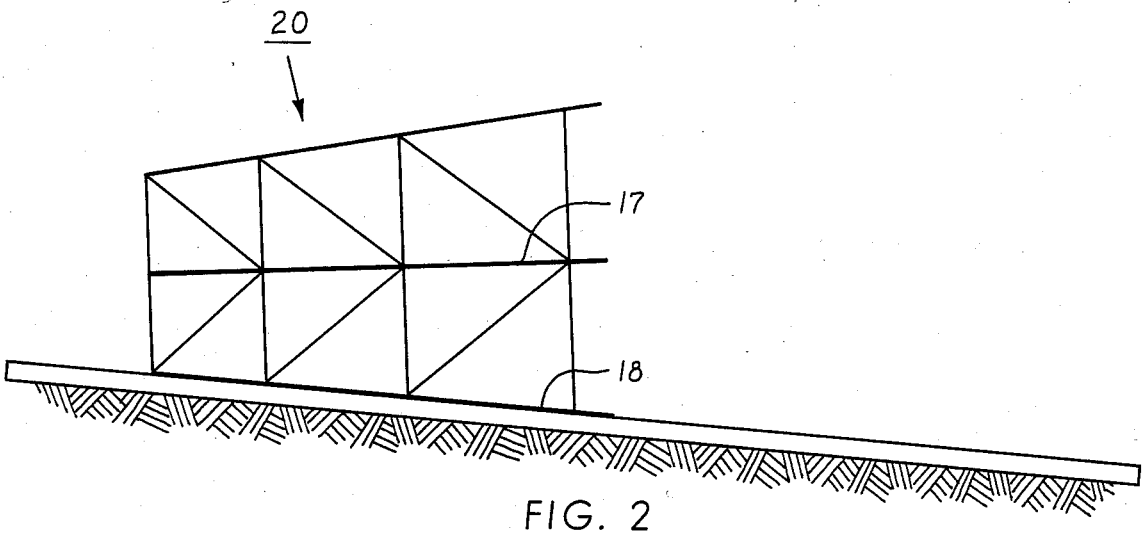
FIG. 2 is a horizontal view of the lower portion of submersible structure of the instant invention as fabricated.

After fitting and welding is completed to assemble each of the two half-sections, half-section 11 is raised vertically to allow half-section 13 to be moved along the skidways and positioned directly beneath it. First half-section 11 is vertically raised sufficiently to enable second half-section 13 to be laterally translated there beneath. Since vertical movement, only, is required, stiff legged cranes may be used to raise said first half-section. The second half-section 13 is slid beneath said raised half-section 11 by means of skids 15. Half-section 11 is then lowered to allow the four lower longitudinal members 17 to fit into the pre-coped ends of the upper members of half-section 13 as shown in FIG. 2. The two sections are then joined, i.e. by welding, to complete the platform base identified by number 20 in FIG. 2. This base section would then be moved along the skidways to allow room to assemble an upper portion 30.

Figure 3:
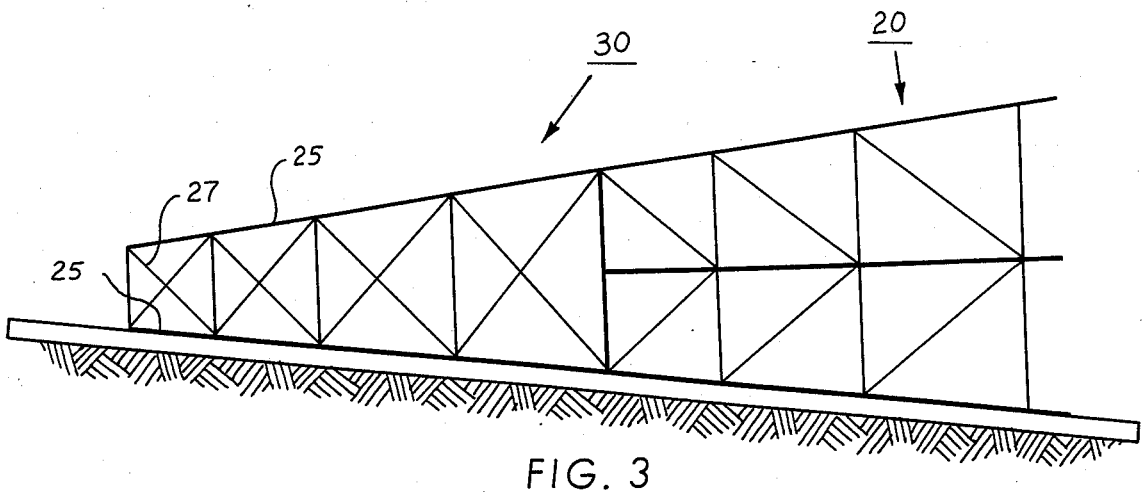
FIG. 3 is horizontal view of the fully assembled submersible structure of the instant invention showing the upper portion joined to the lower portion.
Figure 4:
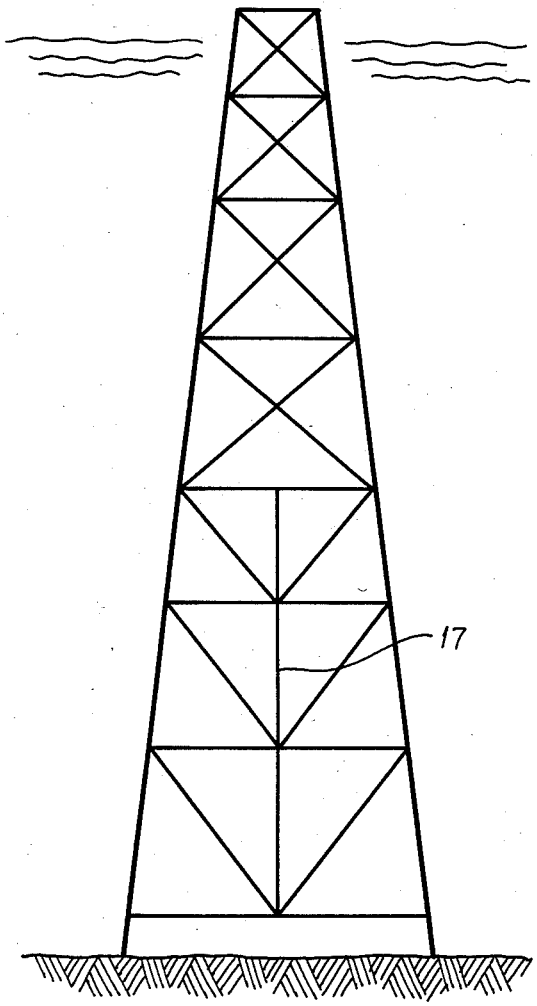
FIG. 4 shows the fully assembled submersible structure of the instant invention rotated to a vertical position and installed on the floor of a body of water.

FIG. 3 shows the assembled lower portion 20 joined to an upper portion 30. The upper portion is fabricated with corner longitudinal tubulars 25 and interconnecting members 27 joined by welding. As shown, the base of the upper portion is dimensioned for mating to the top of the lower portion. The upper portion also includes interior tubulars 24 and 26 as shown in FIG. 5. A pair of top and bottom interior tubulars 24 end at a point below the water line (as shown) where they are replaced by a single top and bottom interior tubular 26. The purpose of a single tubular at the water level is to reduce the force exerted on the structure by wave action. Sections 20 and 30 may be joined together on the skidways as indicated in FIG. 3 and transported to their final destination as one piece. In this instance the complete structure would be rotated to a vertical mode, lowered to bottom and secured with piling, as shown in FIGS. 4 and 5.

Sections 20 and 30 might also be transported separately to an offshore site. The base section 20 could be lowered to the bottom 40, secured with piling and the upper section 30 added.

Another method of installation would be the joining of the base section 20 and the upper section 30 while floating horizontally in the water. The complete structure would then be rotated into the vertical, lowered to bottom and secured with piling.

It will be appreciated by those skilled in the art that, since the lower portion 20 of said submersible structure is fabricated in the horizontal position, the width of said base is not limited to 300 feet or the height of the lower portion limited to 200 feet as are submersible structures fabricated by the prior art method.

While particular embodiments of the invention have been described, it will be understood, of course, that the invention is not limited thereto since many obvious modifications can be made and it is intended to include within this invention any such modifications as will fall within the scope of the appended claims.

I claim:

1. A method for fabricating a broad-based submersible structure having an upper portion and a lower portion and useful for deep water installations by:

(a) fabricating a first half-section of the lower portion of said broad-based submersible structure in a horizontal position, (b) fabricating a second half-section of the lower portion of said broad-based submersible structure, in a horizontal position, adjacent said first half-section, (c) raising said first half-section from the ground to a height sufficient to enable said second half-section to be moved therebeneath, (d) moving said second half-section beneath said raised first half-section, (e) aligning said second half-section with said raised first section, (f) joining said aligned half-sections to provide said lower portion, (g) joining said lower portion to the upper portion to provide said broad-based submersible structure in a horizontal position, and (h) rotating said broad-based, submersible structure from said horizontal position to a generally vertical position.

2. The method of claim 1 wherein said first half-section comprises four corner longitudinal tubulars joined by a plurality of cross members, and said second half-section comprises two corner longitudinal tubulars joined by a plurality of cross members.

3. The method of claim 2 wherein said half-sections further include a plurality of diagonal braces.

4. The method of claim 3 wherein said first half-section further comprises four longitudinal truss members and said second half-section further comprises two longitudinal truss members.

5. The method of claim 4 wherein said second half-section is moved beneath said raised first half-section by sliding along a skidway.

6. The method of claim 5 further comprising raising said first half-section in step (c) by stiff legged crane means.

7. The method of claim 6 wherein the base of said lower portion is greater than 300 feet on each side.

8. The method of claim 6 wherein said upper portion comprises four longitudinal tubulars joined by a plurality of intersecting cross braces.

9. The method of claim 8 wherein the height of said lower portion is greater than 200 feet.

10. A method for fabricating a lower portion for a broad-based submersible structure useful for deep water installation by:

(a) fabricating a first half-section of the lower portion of said broad-based submersible structure in a substantially horizontal position, (b) fabricating a second half-section of the lower portion of said broad-based submersible structure, in a substantially horizontal position, near said first half-section, (c) raising said first half-section from the ground to a height sufficient to enable said second half-section to be moved therebeneath, (d) moving said second half-section beneath said raised first half-section, (e) aligning said second half-section with said raised first section, and (f) joining said aligned half-sections to provide said lower portion.

11. The method of claim 10 wherein said first half-section comprises four corner longitudinal tubulars joined by a plurality of cross members, and said second half-section comprises two corner longitudinal tubulars joined by a plurality of cross members.

12. The method of claim 11 wherein said half-sections further include a plurality of diagonal braces.

13. The method of claim 12 wherein said first half-sections further comprise four longitudinal truss members and said second half-section further comprises two longitudinal truss members.

14. The method of claim 13 wherein said second half-section is moved beneath said raised first half-section in step (d) by sliding along a skidway.

15. The method of claim 14 further comprising raising said first half-section in step (c) by stiff legged crane means.

16. The method of claim 15 wherein said base of said lower portion is greater than 300 feet on each side.

17. The method of claim 16 wherein the height of said lower portion is greater than 200 feet.

18. A method for fabricating a broad-based submersible structure having an upper portion and a lower portion and useful for deep water installations by:

(a) fabricating a first half-section of the lower portion of said broad-based submersible structure horizontal position, (b) fabricating a second half-section of the lower portion of said broad-based submersible structure, in a horizontal position, adjacent said first half-section, (c) raising said first half-section from the ground to a height sufficient to enable said second half-section to be translationally moved therebeneath, (d) aligning said second half-section with said raised first section by moving said second half section beneath said raised first half-section, (e) joining said aligned half-sections to provide said lower portion, (f) installing said lower portion in place by rotating said lower portion to a generally vertical position and positioning the base of said lower portion on the floor underlying a deep body of water, and (g) joining said lower portion to the upper portion to provide said broad-based submersible structure.

19. A broad-based submersible structure having an upper portion and a lower portion and useful for deep water installation prepared by:

(a) fabricating a first half-section of the lower portion of said broad-based submersible structure in a horizontal position, (b) fabricating a second half-section of the lower portion of said broad-based submersible structure, in a horizontal position, adjacent said first half-section, (c) raising said first half-section from the ground to a height sufficient to enable said second half-section to be moved therebeneath, (d) moving said second half-section beneath said raised first half-section, (e) aligning said second half-section with said raised first section, (f) joining said aligned half-sections to provide said lower portion, (g) joining said lower portion to the upper portion to provide said broad-based submersible structure in a horizontal position, and (h) rotating said broad-based, submersible structure from said horizontal position to a generally vertical position.

20. A lower portion for a broad-based submersible structure useful for deep water installation prepared by:

(a) fabricating a first half-section of the lower portion of said broad-based submersible structure in a substantially horizontal position, (b) fabricating a second half-section of the lower portion of said broad-based submersible structure, in a substantially horizontal position, near said first half-section, (c) raising said first half-section from the ground to a height sufficient to enable said second half-section to be moved therebeneath, (d) moving said second half-section beneath said raised first half-section, (e) aligning said second half-section with said raised first section, and (f) joining said aligned half-sections to provide said lower portion.

21. A broad-based submersible structure having an upper portion and a lower portion and useful for deep water installations prepared by:

(a) fabricating a first half-section of the lower portion of said broad-based submersible structure in a horizontal position, (b) fabricating a second half-section of the lower portion of said broad-based submersible structure, in a horizontal position, adjacent said first half-section, (c) raising said first half-section from the ground to a height sufficient to enable said second half-section to be translationally moved therebeneath, (d) aligning said second half-section with said raised first section by moving said second half section beneath said raised first half-section, (e) joining said aligned half-sections to provide said lower portion, (f) installing said lower portion in place by rotating said lower portion to a generally vertical position and positioning the base of said lower portion on the floor underlying a deep body of water, and (g) joining said lower portion to the upper portion to provide said broad-based submersible structure.

* * * * *